US010604313B2

(12) United States Patent
Presche

(10) Patent No.: US 10,604,313 B2
(45) Date of Patent: Mar. 31, 2020

(54) ADMIXER-CLOSURE DEVICE FOR A CONTAINER

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 118 days.

(21) Appl. No.: 15/309,040

(22) PCT Filed: May 6, 2015

(86) PCT No.: PCT/EP2015/059901
§ 371 (c)(1),
(2) Date: Nov. 4, 2016

(87) PCT Pub. No.: WO2015/169821
PCT Pub. Date: Nov. 12, 2015

(65) Prior Publication Data

US 2017/0107030 A1 Apr. 20, 2017

(30) Foreign Application Priority Data

May 7, 2014 (DE) ..... 10 2014 106 369
May 28, 2014 (DE) ..... 10 2014 107 549
Sep. 12, 2014 (DE) ..... 10 2014 113 207

(51) Int. Cl.
*B65D 51/28* (2006.01)
*B65D 41/28* (2006.01)
*B65D 41/04* (2006.01)

(52) U.S. Cl.
CPC ..... *B65D 51/2835* (2013.01); *B65D 41/0407* (2013.01)

(58) Field of Classification Search
CPC ..... B65D 51/2835; B65D 51/2864; B65D 51/2892; B65D 51/2814; B65D 41/0407; B65D 41/28
(Continued)

(56) References Cited

U.S. PATENT DOCUMENTS 3,404,811 A 10/1968 Cernei
3,464,414 A * 9/1969 Sponnoble ..... A61J 1/2093 206/219
(Continued)

FOREIGN PATENT DOCUMENTS

DE 36 01 493 A1 7/1986
DE 86 06 224 U1 7/1987
(Continued)

OTHER PUBLICATIONS

International Search Report of PCT/EP2015/059901, dated Aug. 14, 2015.
(Continued)

*Primary Examiner* — Andrew D Perreault
(74) *Attorney, Agent, or Firm* — Collard & Roe, P.C.

(57) ABSTRACT

The invention relates to a closure device (1) for a container (2) comprising a container opening (3), wherein the closure device (1) comprises a lid element (4) for closing the container opening (3), an inner housing (5) and a chamber (6) arranged on the lid element (4), wherein the chamber (6) is arranged at least partially in the inner housing (5), wherein the inner housing (5) has a first thread (10) which corresponds positively to a thread (10) of the container (2), wherein lid element (4) and inner housing (5) have second threads (11) corresponding positively to one another along which the lid element (4) is movable relative to the inner housing (5) from a closed position into a discharge position in which discharge position a medium stored in the chamber (6) can exit into the container (2). For the usage-advantageous further development of a closure device of the type in question, it is proposed that the first thread (10) and the second thread (11) are configured opposite to one another in such a manner that during a movement into the discharge
(Continued)

Figure 1:
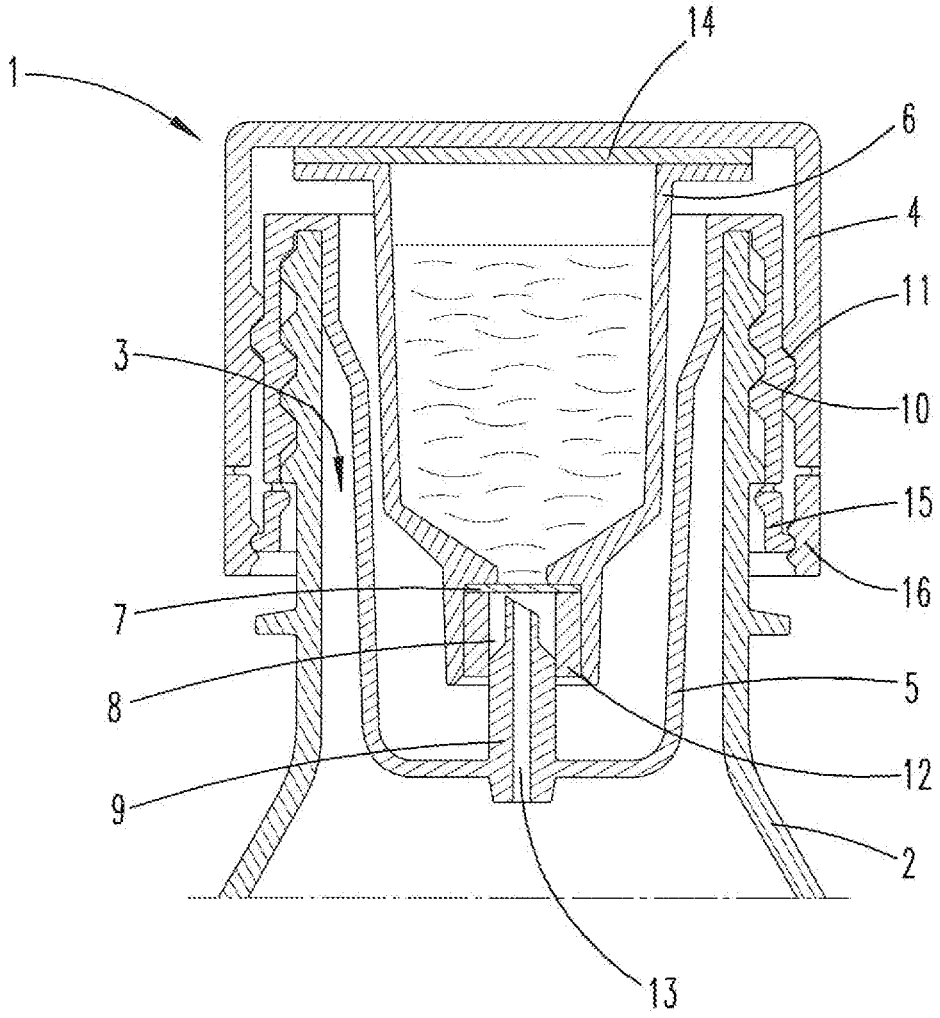

position the chamber (6) is moved further into the inner housing (5).

5 Claims, 6 Drawing Sheets

(58) Field of Classification Search
USPC ..... 206/222; 215/DIG. 8
See application file for complete search history.

(56) References Cited

U.S. PATENT DOCUMENTS

| | | | | |
|---|---|---|---|---|
| 4,903,828 | A | 2/1990 | Finke et al. | |
| 5,353,928 | A | 10/1994 | Schumacher | |
| 5,419,445 | A | 5/1995 | Kaesemeyer | |
| 5,465,835 | A | 11/1995 | Schumacher et al. | |
| 6,561,232 | B1 | 5/2003 | Frutin | |
| 7,025,200 | B2 | 4/2006 | Fontana | |
| 7,210,575 | B2 | 5/2007 | Oswald | |
| 8,151,985 | B2 | 4/2012 | Owoc | |
| 8,672,154 | B2 | 3/2014 | Seelhofer | |
| 8,672,156 | B2 | 3/2014 | Martinovic et al. | |
| 9,944,444 | B2 | 4/2018 | Presche | |
| 2002/0066677 | A1 | 6/2002 | Moscovitz | |
| 2003/0213709 | A1 | 11/2003 | Gibler et al. | |
| 2003/0222102 | A1 | 12/2003 | Cho | |
| 2005/0016875 | A1 | 1/2005 | Rodriguez | |
| 2007/0045134 | A1* | 3/2007 | Dvorak | B65D 41/3428 206/222 |
| 2008/0223741 | A1* | 9/2008 | Nyambi | B65D 51/2835 206/222 |
| 2008/0290061 | A1* | 11/2008 | Seelhofer | B65D 51/2835 215/249 |
| 2008/0314775 | A1 | 12/2008 | Owoc | |
| 2009/0166311 | A1* | 7/2009 | Claessens | B65D 41/28 215/203 |
| 2009/0321286 | A1 | 12/2009 | Frutin | |
| 2010/0012532 | A1* | 1/2010 | Frutin | B65D 47/242 206/221 |
| 2014/0110281 | A1 | 4/2014 | Chen | |
| 2014/0110282 | A1* | 4/2014 | Lee | B65D 25/08 206/219 |
| 2014/0166510 | A1* | 6/2014 | Frutin | B65D 51/2864 206/221 |

FOREIGN PATENT DOCUMENTS

| | | | |
|---|---|---|---|
| DE | 89 00 291 | U1 | 5/1990 |
| DE | 299 22 042 | U1 | 2/2000 |
| DE | 10 2006 047 593 | A1 | 5/2007 |
| DE | 10 2007 011 392 | B3 | 1/2008 |
| EP | 0 520 207 | A1 | 12/1992 |
| EP | 1 975 080 | A1 | 10/2008 |
| EP | 2 383 201 | A1 | 11/2011 |
| EP | 2 240 382 | B1 | 12/2012 |
| FR | 2129923 | A1 | 11/1972 |
| GB | 1231770 | A | 5/1971 |
| WO | 91/17930 | A2 | 11/1991 |
| WO | 2005/014428 | A1 | 2/2005 |
| WO | 2006/037244 | A1 | 4/2006 |
| WO | 2007/129116 | A1 | 11/2007 |
| WO | 2008/017890 | A1 | 2/2008 |
| WO | 2008/072918 | A1 | 6/2008 |

OTHER PUBLICATIONS

International Search Report of PCT/EP2015/059905, dated Aug. 18, 2015.

* cited by examiner

ADMIXER-CLOSURE DEVICE FOR A CONTAINER

CROSS REFERENCE TO RELATED APPLICATIONS

This application is the National Stage of PCT/EP2015/059901 filed on May 6, 2015, which claims priority under 35 U.S.C. § 119 of German Application No. 10 2014 106 369.4 filed on May 7, 2014, German Application No. 10 2014 107 549.8 filed on May 28, 2014, and German Application No. 10 2014 113 207.6 filed on Sep. 12, 2014, the disclosures of which are incorporated by reference. The international application under PCT article 21(2) was not published in English.

The invention relates to a closure device for a container comprising a container opening, wherein the closure device comprises a lid element for closing the container, an inner housing and a chamber arranged on the lid element, wherein the container is arranged at least partially in the inner housing, wherein the inner housing has a first thread which corresponds positively to a thread of the container, wherein lid element and inner housing have second threads corresponding positively to one another, along which the lid element can be moved relative to the inner housing from a closed position into a discharge position in which discharge position a medium stored in the chamber can exit into the container.

Closure devices of the aforesaid type are known in the prior art. These serve to close a container, for example a drinks bottle and at the same time provide a chamber for separate storage of liquid or powdery ingredients, for example, tea essences, so that these do not come in contact and/or are mixed with the contents of the container, i.e. for example water, directly during filling but only at the moment when the closure device is removed from the container. This is usually the moment when a user would like to consume the beverage located in the container.

The closure devices known in the prior art usually consist of a lid element on which the chamber is arranged and an inner housing. The closure device is usually screwed onto the container as a whole, i.e. fully pre-assembled. For this purpose the inner housing has a first thread corresponding positively with the thread of the container. Furthermore, lid element and inner housing are interconnected via positively corresponding second threads. During opening of the container, i.e. when unscrewing the lid element, the lid element is moved relative to the inner housing. In this case, the lid element is moved from a closing position to a discharge position in which discharge position a medium stored in the chamber can exit into the container.

The document WO 2008/017890 A1 relates to such a closure device which upon unscrewing the lid element from the container closed therewith, dispenses a medium located in the chamber into the container. The chamber is closed with a membrane in relation to a closed position. In the discharge position this membrane is pierced by an opening element arranged on the inner housing, namely a mandrel with integrated discharge channel. Through the opening in the membrane the medium located in the chamber can flow through the discharge channel of the mandrel into the container. The piercing of the membrane by means of the mandrel is brought about by an unscrewing movement of the lid element from the inner housing arranged on the container. As a result of the unscrewing movement of the lid element, the chamber arranged on the lid element is basically moved away from the mandrel. As a result of a left-hand thread arranged between the lid element and the mandrel, however, a movement of the mandrel in the direction of the membrane is brought about at the same time until the mandrel cuts through the membrane. To this end the mandrel is mounted on the inner housing in a longitudinally movable but torque-proof manner. The closure device can finally be unscrewed from the container by means of the first thread arranged between container and inner housing.

A disadvantage of the closure device known in the prior art is that for a movement of the mandrel in the direction of the membrane, there must be an axial movability of the mandrel inside the lid element whilst at the same time torsional strength must be achieved. As a result, the proportion of elements arranged movably in the closure device is increased which on the one hand results in a more complex manufacture of the closure device and on the other hand could cause tilting of the mandrel mounted movably in the lid element, which would impede the problem-free function of the closure device.

It is therefore the object of the invention to further develop the closure device known in the prior art so that this can be manufactured with few components and cost-effectively and in particular the number of movable parts is reduced. Overall a problem-free function of the closure device should also be achieved.

In order to solve the aforesaid object the invention proposes a closure device according to the preamble of claim 1 in which the first thread arranged between inner housing and container and the second thread arranged between lid element and inner housing are configured to be opposite to one another in such a manner that during a movement into the discharge position, the chamber is moved further into the inner housing.

As a result of the aforesaid opposite nature of the threads between inner housing and container or between lid element and inner housing, the left-hand thread contrary to the prior art is shifted into a region outside the container, namely preferably on the outer wall of the container opening. Thus, the movable mounting of the opening element on the inner housing required in the prior art is also dispensed with. On the contrary, the opening element according to the invention is directly configured in one part with the inner housing. Thus, the manufacture of the closure device is particularly simple and cost-effective. In addition, no undesirable tilting of the movably mounted opening element inside the outlet opening of the chamber can come about.

It is recommended that the second threads, which are arranged correspondingly on lid element and inner housing, are configured as left-hand threads whereas the first threads which are arranged between inner housing and container are configured as right hand threads. As a result of this configuration, the lid element is moved along the left-hand thread during a rotational movement in the anticlockwise direction towards the inner housing so that the opening means arranged on the inner housing can cut through a closure means arranged on the chamber and thus the medium which is stored in the chamber can exit into the container. The user of the closure device can therefore unscrew the container as usual by turning anticlockwise. In this case, firstly a movement of the lid element in the direction of the inner housing is accomplished, i.e. in the case of upright containers, downwards whilst then the rotational movement is transferred to the first thread arranged between container and inner housing so that the closure device can be completely unscrewed from the container. By actuating this right-hand thread, the closure device, i.e. specifically the inner housing, is unscrewed from the container.

The user does not need to change the direction of rotation of the rotational movement of the lid element. On the contrary the different threads initially cause a lowering of the lid element and then a raising of the lid element relative to the container during the same rotational movement of the lid element.

It is recommended in the sense of the invention that the second thread can be actuated temporally prior to the first thread. As a result, before the actual unscrewing from the container, the closure device initially adopts the discharge position in which the medium stored in the chamber can exit into the container.

This specifically means that the medium can exit from the container during the entire subsequent unscrewing from the container. It is thus possible that the chamber is completely emptied during the final separation of the closure device from the container. A subsequent dripping from the container is therefore minimized. In contrast to the prior art, this is a crucial advantage since the movements there along the right-hand thread and the left-hand thread take place at the same time. Thus, the effective time which is available for exit of the medium from the chamber into the container is disadvantageously shortened.

It is proposed that the chamber has a discharge opening provided with a closure means which can be opened by means of an opening means arranged on the inner housing. Thus, the chamber arranged on the lid element and the inner housing have corresponding elements, namely a closure means and an opening means which cooperate according to the invention during a movement of the lid element in the direction of the inner housing. During the rotational movement of the lid element along the second thread, the chamber is moved in the direction of the opening means until finally the opening means acts on the closure means and thus the closure means releases the discharge opening formed in the chamber.

According to one variant, the opening means can be configured as a mandrel. In combination the closure means can be configured as a membrane which closes the discharge opening. In this case, the mandrel and the membrane advantageously cooperate so that the mandrel passes through or cuts the membrane. The membrane can, for example, be a metal film, for example aluminium film. Alternatively membranes made of plastic, for example, PBT are also suitable so that the membrane is preferably made of the same material as the chamber. Advantageously the membrane is welded onto the chamber. The mandrel can, for example, be configured to be needle-shaped or also blade-shaped, where the membrane rotates due to the rotating movement of the lid element above the mandrel so that advantageously not only a punctiform penetration point is formed but the membrane is destroyed over the largest possible area so that the discharge opened is released over the largest possible area. If the mandrel is configured to be needle-shaped, it is recommended to arrange this outside the axis of rotation of the membrane.

Advantageously a sealing element is arranged on the side of the closure means facing away from the chamber. Since the chamber is sealed with the closure means during the closed position, the additional sealing element can be arranged outside the chamber. In this respect, the demands on the material of the sealing element are lower than if the sealing element comes directly in contact with the medium stored in the container. Advantageously the sealing element is a thermoplastic elastomer. Thermoplastic elastomers (TPE) have the advantage that these can be welded in order, for example, to produce watertight connections. Advantageously the sealing element is in this case arranged between the chamber and the opening means where these are sealed as far as possible free from gaps. The opening means can in particular be continuously connected to the sealing element during the movement from the closed position into the discharge position wherein the opening means has a discharge channel through which the medium arranged in the chamber can flow in order to enter into the container from the chamber.

According to a further embodiment of the invention, it can be provided that the closure means is a stopper element formed in one piece with the opening means. In this case, a separate closure means which closes the discharge opening in the sense of a membrane is superfluous. On the contrary, the shape of the discharge opening and the shape of the stopper element can be configured to correspond to one another so that during the movement from the closed position into the discharge position the stopper element first completely closes the discharge opening and then releases a discharge channel through which the medium can exit from the chamber into the container.

In addition to the previously presented closure device for a container, the invention also proposes a container with an aforesaid closure device, wherein the container opening of the container has a first thread which is connected in a positively corresponding manner to a first thread of the inner housing.

Furthermore, the invention proposes a method for dispensing a medium from a closure device into a container, in particular from a closure device as presented previously, wherein the closure device has a lid element for closing a container opening of the container, an inner housing and a chamber arranged on the lid element, wherein when the closure device changes from the closed position into a discharge position, the lid element is moved in the direction of the container with the result that the chamber arranged on the lid element is moved onto the inner housing arranged on the container, wherein an opening means arranged on the inner housing releases a closure means arranged on the chamber with the result that a medium located in the chamber can exit from the chamber into the container. According to the invention, a method is therefore proposed in which during a usual opening movement of the container, i.e. during rotation of the lid element in the anticlockwise direction, the lid element is moved in the direction of the inner housing, i.e. of the container, with the result that finally the opening means arranged on the inner housing cooperates with a closure means arranged on the chamber in the sense that the closure means releases a discharge channel so that a medium located in the chamber can exit into the container. In particular it is possible here that the lid element is moved along a left-hand thread in a direction towards the container.

Figure 2:
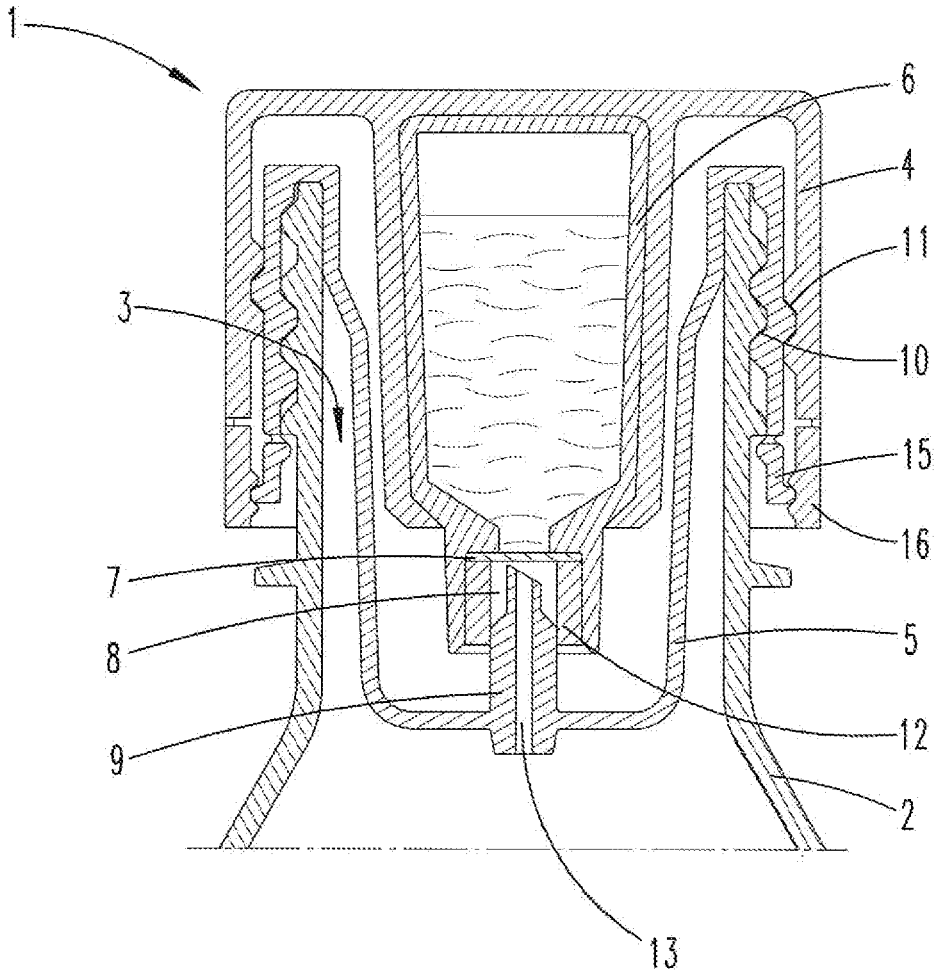
Figure 3:
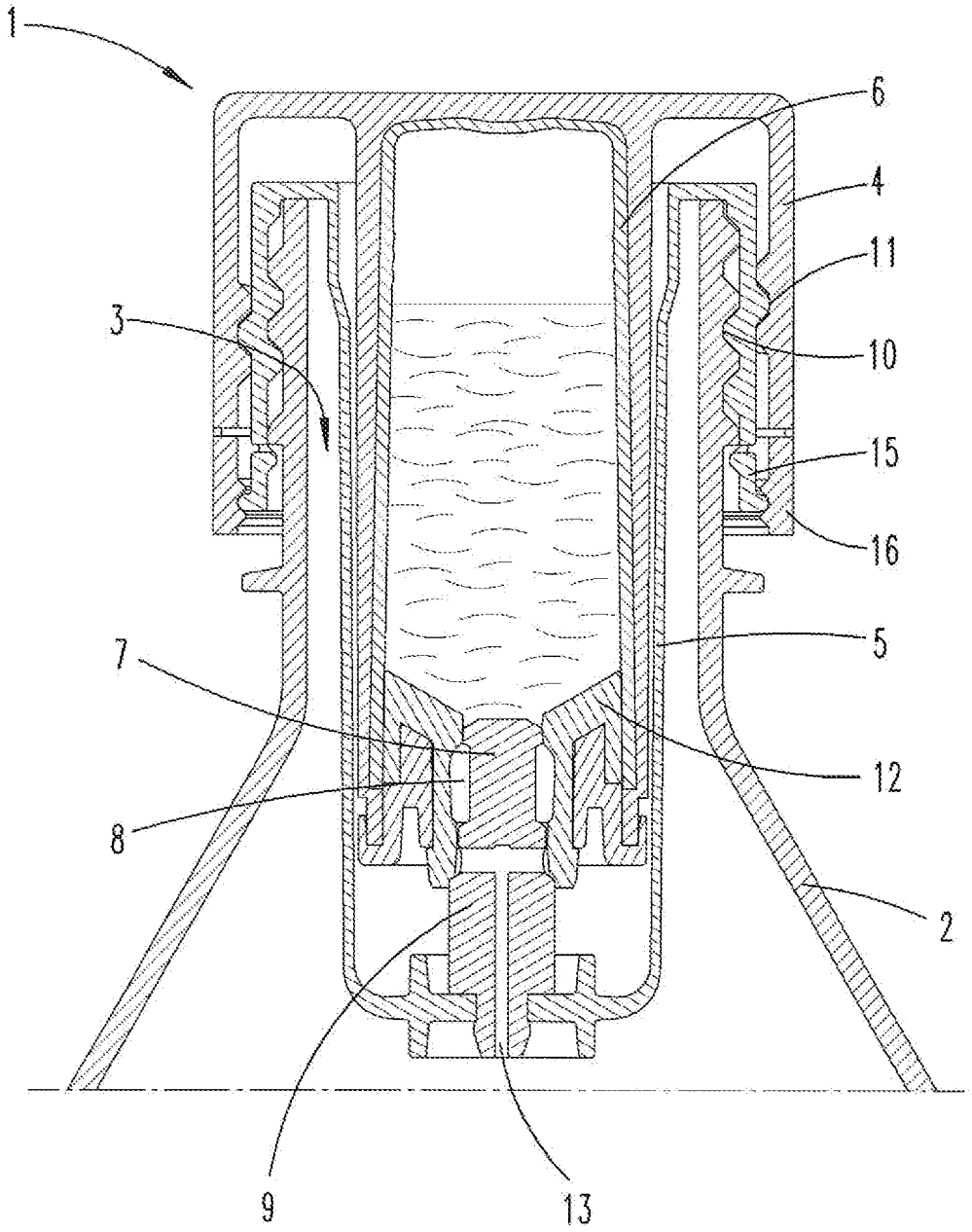
Figure 4:
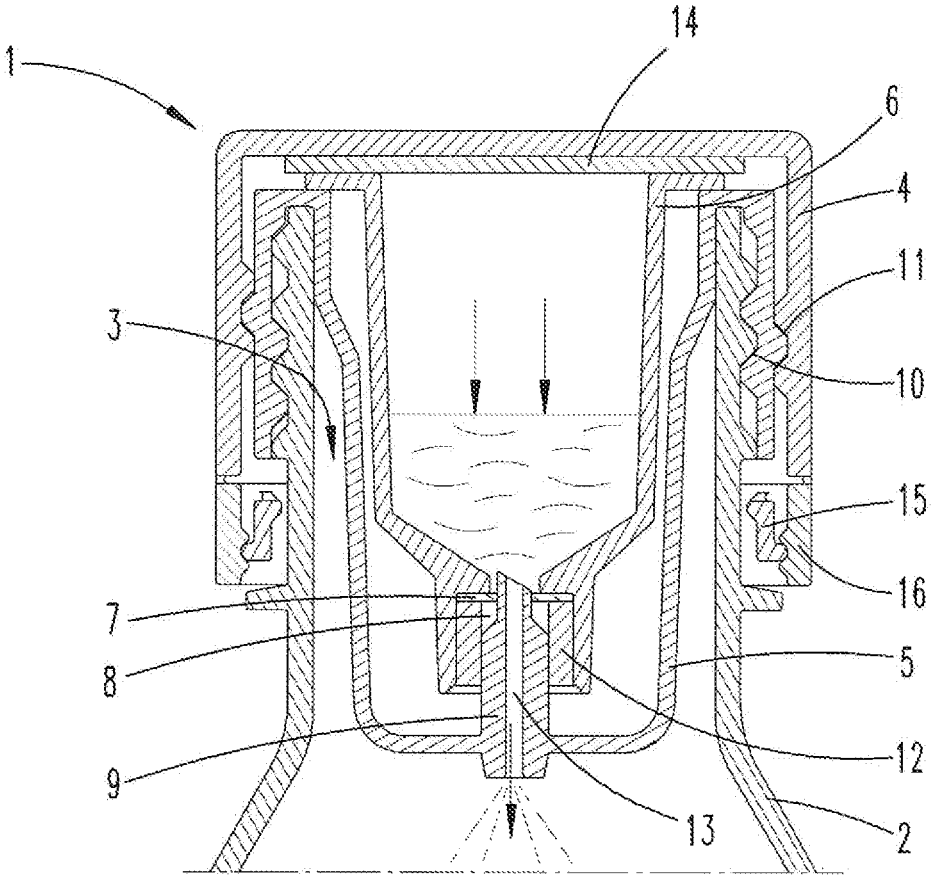
Figure 5:
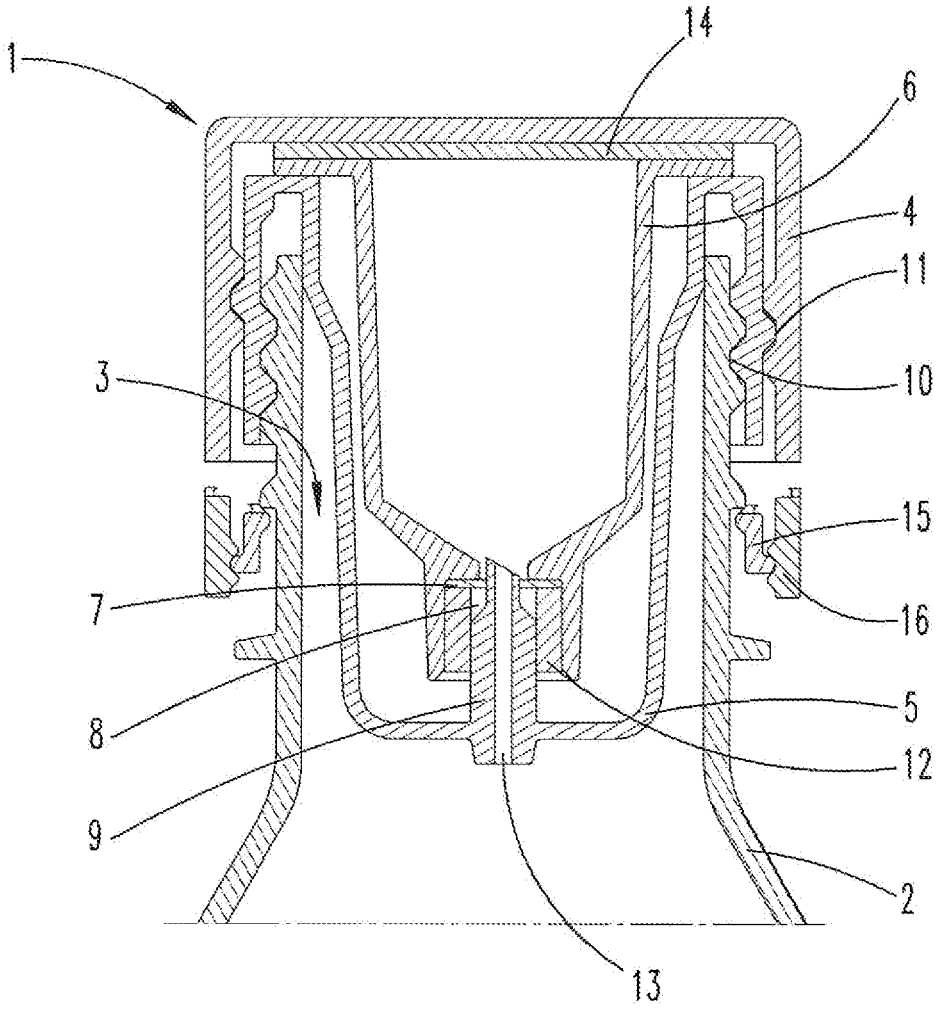
Figure 6:
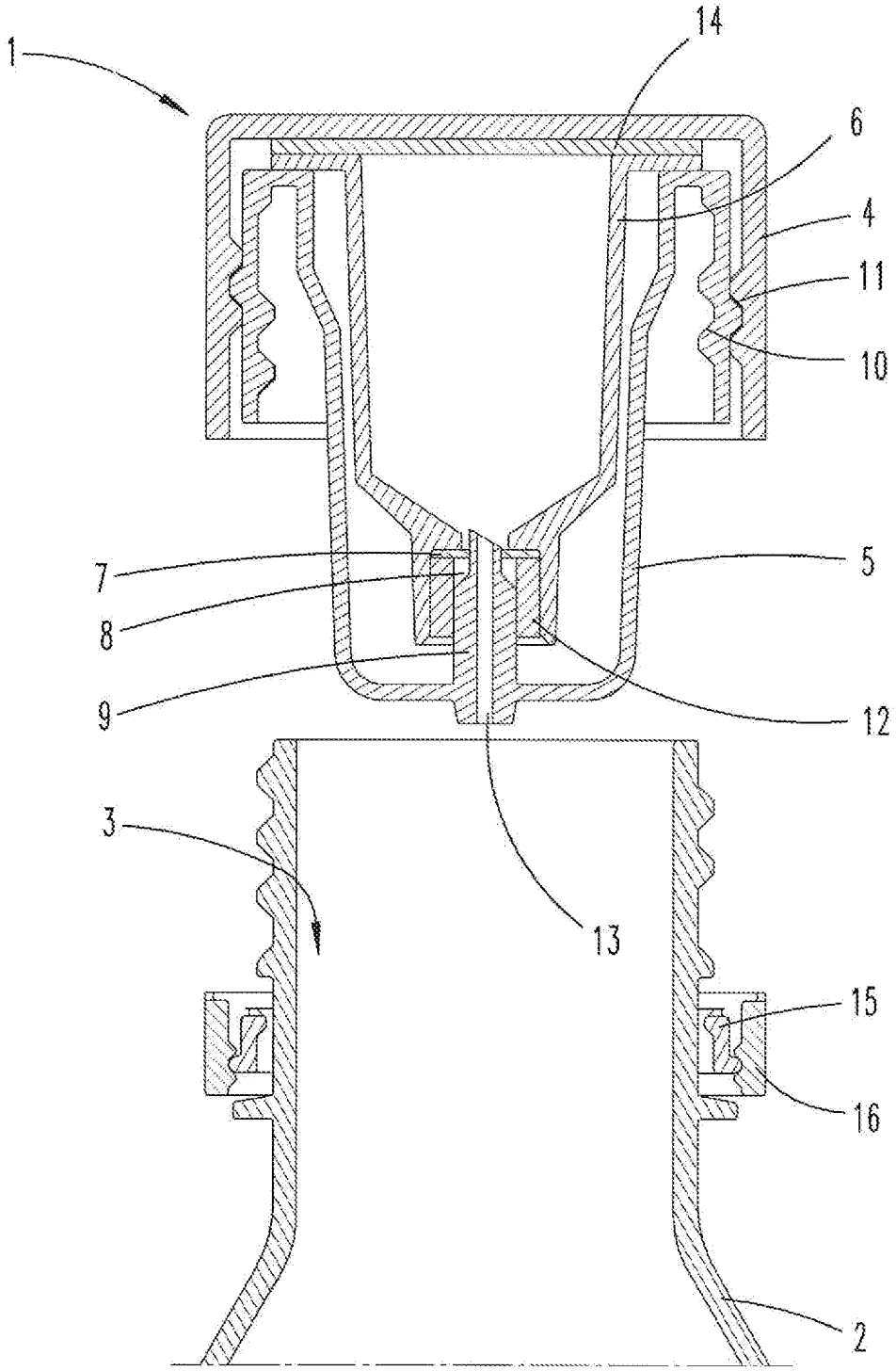

The invention is explained in detail hereinafter with reference to exemplary embodiments. In the figures:

FIG. 1: shows a closure device according to the invention according to a first embodiment in the closed position;

FIG. 2: shows a closure device according to the invention according to a second embodiment in the closed position;

FIG. 3: shows a closure device according to the invention according to a third embodiment in the closed position;

FIG. 4: shows the closure device according to FIG. 1 in the discharge position;

FIG. 5: shows the closure device according to FIG. 1 during unscrewing from a container;

FIG. 6: shows the closure device according to FIG. 1 completely separate from the container.

FIGS. 1 to 3 show different embodiments of a closure device according to the invention. These differ on the one hand by the configuration of the chamber arranged on the lid element and on the other hand by the type of closure means and opening means.

FIG. 1 shows a closure device 1 which is arranged on a container 2, for example, a drinks bottle. The closure device 1 is screwed onto the container 2 in the region of the container opening 3. The closure device 1 comprises a lid element 4, an inner housing 5 as well as a chamber 6 arranged on the lid element 4. The chamber 6 is arranged at least partially in the inner housing 5, where an upper partial region of the chamber 6 in the vertical direction projects from the inner housing 5. Located in the chamber 6 is a medium which, for example, can be a liquid or a powder. The chamber 6 has a discharge opening 8 at its lower end, which is closed by means of a closure means 7, here an aluminium film. Advantageously the closure means 7 is welded onto the chamber 6. The inner housing 5 has an opening means 9, here a mandrel. This opening means 9 in the closed position of the closure device 1 preferably projects into the discharge opening 8 but in the given case only insofar that the opening means 9 does not touch or only touches in a non-injurious manner the closure means 7. Touches in a non-injurious manner herewith means that no damage to the closure means occurs so that no unintentional exit of the medium can occur. However, a certain contact can optionally occur. The discharge opening 8 can be sealed with respect to the opening means 9 by a sealing element 12. This is then let into the discharge opening 8 in an annular shape. The opening means 9 furthermore has a discharge channel 13 through which the medium stored in the chamber 6 can flow from the chamber 6 into the container 2 in the open position of the closure means 7.

During manufacture of the closure device shown in FIG. 1, the chamber 6 is closed with a film element 14. This film element 14 is advantageously welded-on or glued-on to an edge region of the chamber. Furthermore, the film element 14 is advantageously also welded-on or glued-on to the lid element 4. For attachment of the closure device 1 to the container 2, the inner housing 5 with integrated opening means 9 is first screwed onto the container 2. For this purpose the inner housing 5 has a U-shaped edge region which bears a first thread 10 on the side directed towards the outer wall of the container 2. The container 2 has a positively corresponding first thread 10 so that the inner housing 5 can be screwed onto the container 2. The lid element 4 with the chamber 6 arranged thereon is then screwed onto the inner housing 5 (and thus at the same time onto the container 2). To this end a second thread 11 arranged on the inner side of the lid element 4 is brought into engagement with an outwardly pointing second thread 11 of the side edge of the inner housing 5. The lid element 4 is screwed onto the inner housing 5 until a snap-in element 16 arranged on the lid element 4 engages in a projection 15 arranged on the inner housing 5. This corresponds to a position in which the opening means 9 engages in the discharge opening 8 of the chamber 6 in such a manner that the closure means 7 introduced into the discharge opening 8 is not destroyed.

FIG. 2 shows a second embodiment of a closure device 1 according to the invention which, instead of a chamber 6 closed with a film element 14, has a completely closed chamber 6 apart from the discharge opening 8. This chamber 6 is over-moulded in a cylinder shape by the material of the lid element 4 so that chamber 6 and lid element 4 are firmly connected to one another. Otherwise, the configuration is shown as before with reference to the closure device 1 according to FIG. 1.

FIG. 3 shows a closure device 1 according to a third embodiment. This closure device 1 has a chamber 6 which is configured as shown in FIG. 2, i.e.—apart from the discharge opening 8—is completely closed. This chamber 6 is over-moulded in a cylinder shape by the material of the lid element 4 so that chamber 6 and lid element 4 are firmly connected to one another. In contrast to a separate closure means 7 and a separate opening means 9, the closure device 1 according to FIG. 3 has a stopper element formed in one part, which comprises both a closure means 7 and an opening means 9. The stopper element is arranged on the inner housing 5, wherein at least the closure means 7 as upper end region of the stopper element projects into the discharge opening 8 associated with the chamber 6. A sealing element 12 is arranged in the discharge opening 8 which, depending on the position of the closure means 7, abuts or does not abut against this. FIG. 3 shows the closed position of the closure device 1. In this position the closure means 7 abuts against the sealing element 12 with an expanded end region and closes the discharge channel 13 so that the medium stored in the chamber 6 cannot flow out. In a discharge position of the closure device 1 not shown, the closure means 7 on the other hand is moved further into the chamber 6 ("upwards" in FIG. 3) so that the expanded end region of the closure means 7 no longer abuts against the sealing element 12 and the discharge channel 13 is released.

The mode of operation of the closure device 1 is explained in detail hereinafter with reference to FIGS. 4 to 6. FIGS. 4 to 6 relate to the embodiment shown in FIG. 1.

The closure device 1 shown in FIG. 4 is located in a discharge position. Starting from the closed position shown in FIG. 1, this discharge position is reached by moving the lid element 4 in the direction of the container 2, whereby the chamber 6 is moved further into the inner housing 5. This is accomplished by a rotation of the lid element 4 along the second thread 11 formed between lid element 4 and inner housing 5 which is configured as a left-hand thread. Since the second thread 11 is a left-hand thread, during a usual opening movement of the container 2 the lid element 4 is turned further in the anticlockwise direction onto the container 2. For the user however the usual manner of actuation during an opening process in the anticlockwise direction is obtained so that no different handling must be noted as a result. As a result of the movement of the lid element 4 towards the container 2, the chamber 6 arranged on the lid element 4 is at the same time moved further into the container 2. The closure means 7 located in the discharge opening 8 of the chamber 6 thus comes in contact with the opening means 9 arranged on the inner housing 5. The opening means 9, as explained previously, is a cutting element which has a central discharge channel 13 through which medium can flow from the chamber 6 into the container 2 if the closure means 7 introduced in the discharge opening 8 is destroyed. As a result of the rotation of the lid element 4, the closure means 7 also rotates at the same time relative to the opening means 9 so that a large-area, substantially round opening is obtained inside the discharge opening 8 of the chamber 6. In this discharge position the lid element 4 is screwed onto the inner housing 5 and therefore the container 2 as far as possible.

In the diagrammatic view the position of the outwardly projecting thread projection of the chamber 5 has not changed between FIG. 1 and Fig. This is attributable to the fact that the chamber 5 also has not changed its position in the screwing-on or unscrewing direction between FIG. 1 and FIG. 5. On the contrary the thread projection has only been exceeded as a result of the rotation of the corresponding recess on the inner wall of the cover element 4 which accordingly always results in the same relative arrangement with respect to one another in the same sectional plane.

FIG. 5 shows the closure device 1 according to the invention during unscrewing from the container 2. As a result of a further rotation of the lid element 4 in the anticlockwise direction, the inner housing 5 and therefore also the lid element 4 arranged on the inner housing 5 is unscrewed from the container 2. Since the first threads 10 formed between inner housing 5 and container 2 are configured as right-hand threads, the closure device 1 overall is moved away from the container 2. During this unscrewing process the medium stored in the chamber 6 can escape completely into the container 2.

FIG. 6 finally shows the closure device in a state in which the closure device 1 is completely separated from the container 2. In this case, all the components of the closure device 1, namely in particular the lid element 4 with chamber 6 mounted thereon and the inner housing 5 are separated from the container 2.

With reference to the closure devices 1 shown in FIGS. 2 and 3, the invention functions similarly. It should be emphasized here in each case that the closure device 1 is always transferred from a closed position into a discharge position via the same thread mechanism. This thread mechanism includes a left-hand thread which provides for the movement of the lid element 4 in the direction of the inner housing 5 and a right-hand thread which ultimately provides for separation of the closure device 1, in particular the inner housing 5, from the container 2.

According to FIG. 3, the opening of the discharge opening 8 does not function via corresponding closure means 7 and opening means 9 which are configured as membrane and mandrel, but rather via a one-part stopper element which takes on the function of the closure means 7 and of the opening means 9. Depending on the position of the stopper element inside the discharge opening 8, a discharge channel 13 formed between stopper element and sealing element 12 is either closed or open.

REFERENCE LIST

1 Closure device
2 Container
3 Container opening
4 Lid element
5 Inner housing
6 Chamber
7 Closure means
8 Discharge opening
9 Opening means
10 First thread
11 Second thread
12 Sealing element
13 Discharge channel
14 Film element
15 Projection
16 Latching element

The invention claimed is:

1. A closure device for a container comprising a container opening, comprising:

a lid element for closing the container opening, and an inner housing and a chamber combined with the lid element, wherein the chamber has a discharge opening closed by a closure element and the inner housing has an opening element to open the closure element, the opening element being configured as a cutting element and having a central through-opening extending through a front side of the opening element, wherein there is an annular sealing element formed of thermoplastic elastomer fitted in the discharge opening, the annular sealing element being disposed entirely within the discharge opening and disposed on the side of the closure element facing away from the chamber, the sealing element sealing against the opening element, wherein the closure element is a membrane and is sandwiched directly between a wall of the chamber and the sealing element, wherein the chamber is arranged at least partially in the inner housing, wherein the inner housing has a first thread which corresponds positively to a thread of the container, wherein lid element and inner housing have second threads corresponding positively to one another along which the lid element is movable relative to the inner housing from a closed position into a discharge position in which discharge position a medium stored in the chamber can exit into the container, and wherein the first thread and the second thread are disposed opposite to one another in such a manner that during a movement into the discharge position the chamber is moved further into the inner housing.

2. The closure device according to claim 1, wherein the second thread is configured as a left-hand thread and the first thread is configured as a right-hand thread.

3. The closure device according to claim 1, wherein the second thread can be actuated prior to the first thread.

4. The closure device according to claim 1, wherein the opening element is configured as a mandrel disposed inside the annular sealing element.

5. A container having a container opening and the closure device according to claim 1, wherein the container opening has a first thread which is connected in a positively corresponding manner to the first thread of the inner housing.

* * * * *